United States Patent [19]

DiMarco et al.

[11] Patent Number: 4,675,640

[45] Date of Patent: Jun. 23, 1987

[54] LINE TERMINAL ASSEMBLY FOR A CIRCUIT BREAKER

[75] Inventors: Bernard DiMarco, Lilburn, Ga.; Charles W. Stanford, Bellefontaine, Ohio

[73] Assignee: Siemens Energy & Automation, Inc., Atlanta, Ga.

[21] Appl. No.: 905,796

[22] Filed: Sep. 10, 1986

[51] Int. Cl.[4] ..... H01H 71/16

[52] U.S. Cl. ..... 337/70; 335/43

[58] Field of Search ..... 337/70, 71, 75; 335/23, 335/35, 36, 37, 38, 39, 40, 41, 42, 43

[56] References Cited

U.S. PATENT DOCUMENTS

| | | | |
|---|---|---|---|
| 3,588,413 | 6/1971 | Stanback | 200/254 |
| 3,908,110 | 9/1975 | Heft | 335/36 |
| 4,231,006 | 10/1980 | Belttary | 335/43 |
| 4,316,163 | 2/1982 | Roy | 335/43 |

*Primary Examiner*—Harold Broome

*Attorney, Agent, or Firm*—Volker R. Ulbrich

[57] ABSTRACT

A line terminal assembly is provided for a circuit breaker. The line terminal assembly includes a line terminal which has an interior arm and first and second exterior arms with a bimetallic element connected to the interior arm. A screw passes through a bracket and threadably engages the interior arm. Torquing the screw causes the interior arm and bimetallic element to move relative to the exterior arms thereby varying the tripping current of the breaker.

13 Claims, 5 Drawing Figures

LINE TERMINAL ASSEMBLY FOR A CIRCUIT BREAKER

CROSS-REFERENCE TO RELATED APPLICATIONS

This application is related to application Ser. No. 905,795 "Electromagnetic Structure For a Circuit Breaker", Bernard DiMarco and Charles Stanford.

BACKGROUND OF THE INVENTION

This invention relates generally to molded case circuit breakers and more particularly to a line terminal assembly for a circuit breaker.

In a circuit breaker, line current enters through a line terminal assembly which includes a line terminal lug for mechanically fastening the line to the terminal assembly. Electrical current typically travels from the line terminal lug through the line terminal assembly to the circuit breaker contact assembly. It is desirable to cause the circuit breaker to trip in reponse to current flow through the circuit breaker of a certain magnitude to protect the circuit in which it is connected from over current conditions. This function is accomplished in thermal-magnetic circuit breakers by the use of a thermal element in conjunction with a magnetic structure.

In a circuit breaker, it is customary to provide for adjusting the current level at which the circuit breaker will trip. This insures that the circuit breaker will trip at a preselected level above its rated current. Typically, the thermal element is a bimetallic strip which bends when heated in response to the flow of current through it. The bimetallic element operates the trip lever of the circuit breaker which causes the circuit breaker to topen thereby interrupting the flow of current through the circuit breaker when the current flow heats the bimetallic strip. The bimetallic strip is very sensitive, and understandably, adjusting or calibrating the bimetallic strip is a very delicate operation.

Since current flows through the bimetallic strip, it is connected so that current flow from the line terminal flows through the line terminal to the bimetallic strip through the bimetallic strip to the circuit breaker operating contacts. Connection from the bimetallic strip to the contact assembly is conveniently made by way of a flexible connector such as a pigtail connector. Unfortunately, the presence of the pigtail connector can be felt by the bimetallic strip and can interfere with the operation and, more importantly, the calibration of the circuit breaker. Accordingly, it will be appreciated that it would be highly desirable to provide a thermal element for a molded case circuit breaker which is easy to calibrate and is not severely affected by its connection to the contact assembly.

The molded case circuit breaker has a molder case with ribs, grooves or barriers fabricted therein for receiving the components of the line terminal assembly. Circuit breakers are items which are mass produced and are made within certain manufucaturing tolerances; thus, the molded case is made to accomodate all of the expected variances in the components of the line terminal assembly. The net result is that a tight, precision fit of the components in the molded case is not always achieved, which can lead to variations in the tripping current of the circuit breaker. For this reason, calibration of each circuit breaker is necessary. Accordingly, it will be appreciated that it would be highly desirable to provide a circuit breaker which provides a tight fit for the components of the line terminal assembly.

Accordingly, it is an object of the present invention to provide a molded case circuit breaker which has a line terminal assembly which fits tightly in the molded case of the circuit breaker.

Another object of the present invention is to provide a line terminal assembly which has a bimetallic element and can be easily calibrated.

SUMMARY OF THE INVENTION

Briefly stated, in accordance with one aspect of the invention, the foregoing objects are achieved by providing a line terminal assembly for a circuit breaker which has a tripping current. The line terminal assembly has an interior arm and first and second exterior arms disposed outboard of the interior arm along opposite sides thereof. A bimetallic element has one end connected to the interior arm and an adjusting screw threadably engages the interior arm. A bracket has a general U configuration with the legs of the U abutting the exterior arms and with a central portion of the U having an opening through which the screw passes with a head of the screw abutting the central portion whereby turning the screw moves the interior arm and bimetallic element relative to the exterior arms and varies.the tripping current of the circuit breaker.

BRIEF DESCRIPTION OF THE DRAWINGS

While the specification concludes with claims particularly pointing out and distinctly claiming the subject matter which is regarded as the invention, it is believed that the invention will be better understood from the following description of the preferred embodiment taken in conjunction with the accompanying drawings in which:

DESCRIPTION OF THE PREFERRED EMBODIMENT

Figure 1:
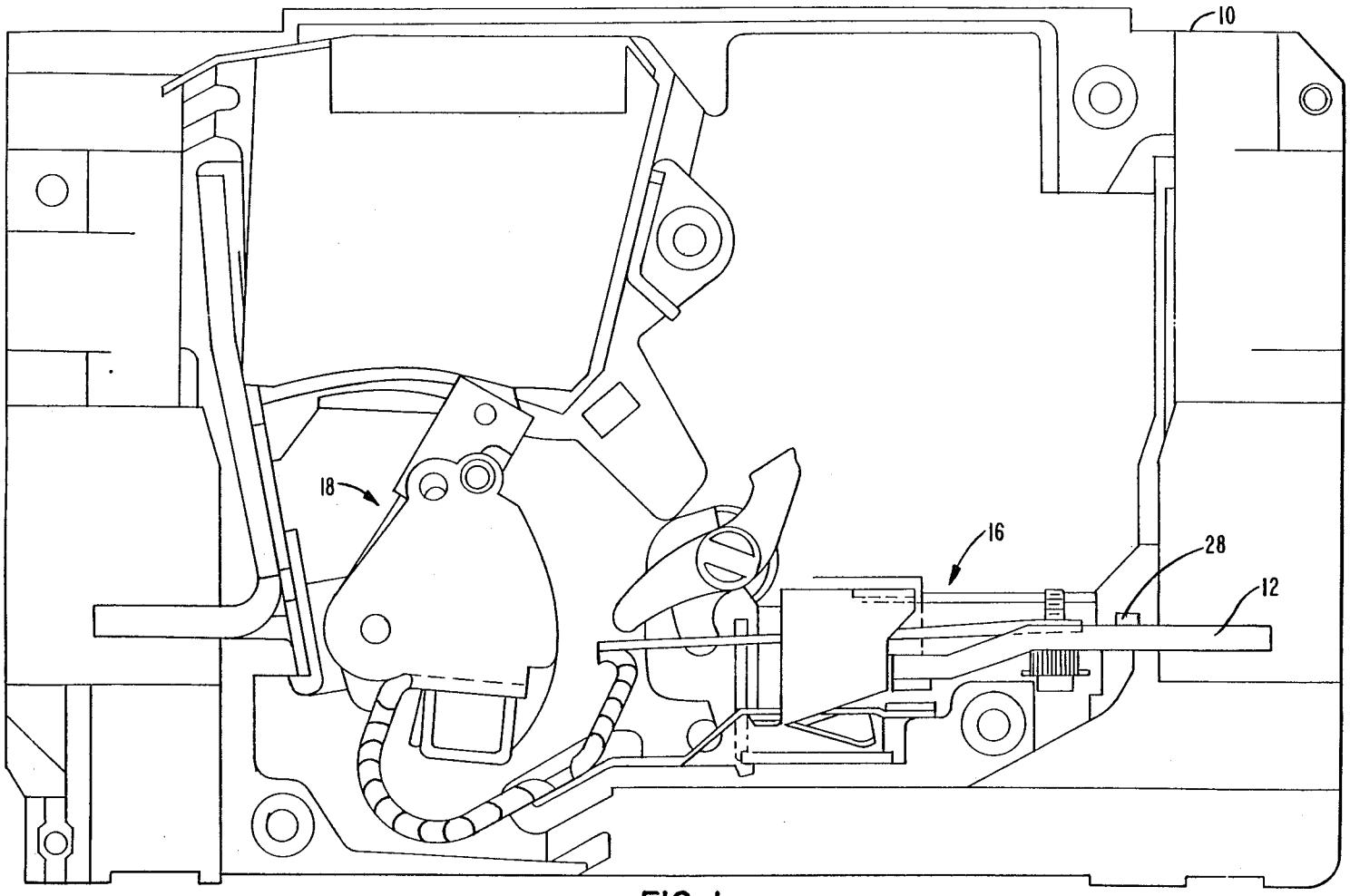
FIG. 1 illustrates a circuit breaker with the cover removed to expose the line terminal assembly.
Figure 2:
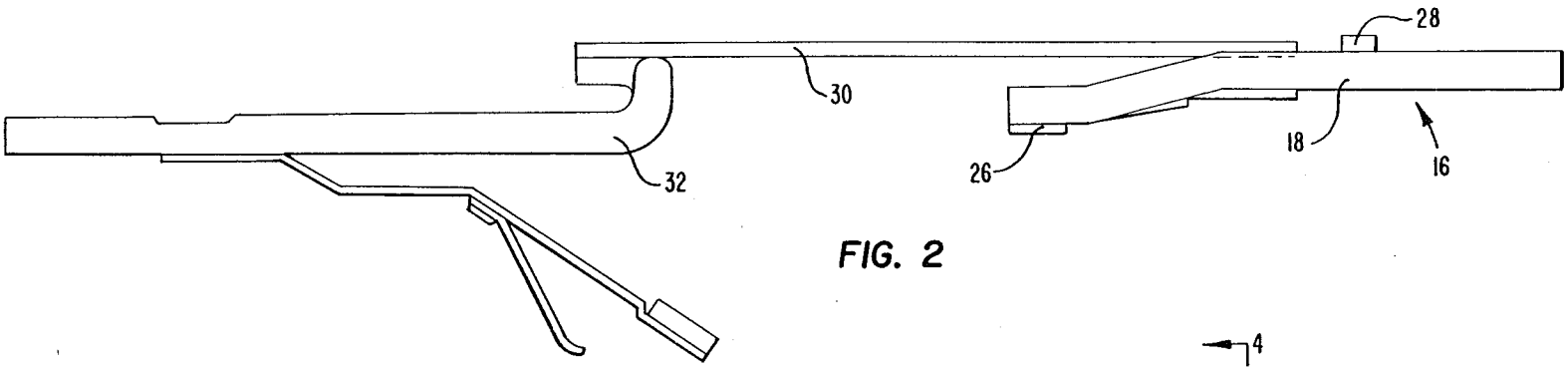
FIG. 2 is a simplified diagrammatic view of the line terminal assembly illustrating the connection of the bimetallic element and pigtail connector.
Figure 3:
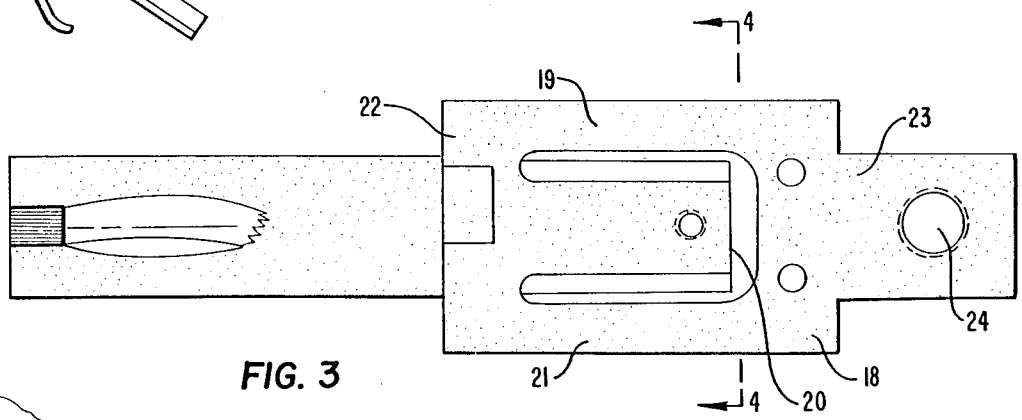
FIG. 3 is a somewhat simplified enlarged plan view of the line terminal of FIG. 2.
Figure 4:
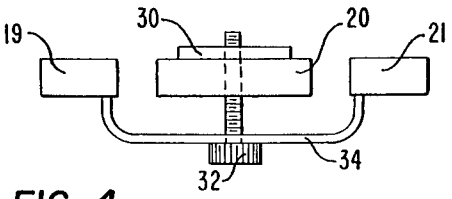
FIG. 4 is a diagrammatic view of the line terminal taken generally along line IV—IV of FIG. 3.
Figure 5:
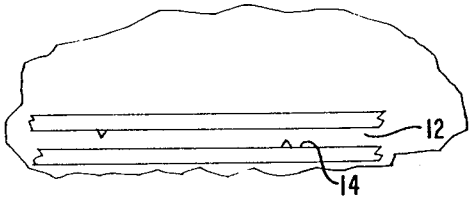
FIG. 5 illustrates the crushable ribs of the circuit breaker case.

Referring to FIG. 1, a molded case circuit breaker has a molded case 10 with grooves or passageways 12 into which components are inserted as will be more fully described hereinafter. The passageways 12 preferably contain one or more crushable ribs 14 (FIG. 5) which are deformed upon insertion of a component into the passageway 12 securing the component in the passageway and insuring a tight fit of the component in the circuit breaker. The circuit breaker also includes a line terminal assembly 16 and a contact assembly 18. The associated magnetic structure is described in the above referenced application Ser. No. 905,795 which is incorporated herein by referrence. Referring to FIGS. 1 through 4, the line terminal assembly 16 includes a contact assembly 18 which has an interior arm 20 and exterior arms 19, 2l disposed outboard of the interior arm 20 along opposite sides thereof. Each of the arms has a first end and a second end with the first ends electrically connected together by a connecting section 22. A terminal section 23 connects the exterior arms together at their second ends and is adapted for a fixed connection to an external circuit by means of an opening 24 which can accomodate a terminal lug as is known in the art. As seen in FIG. 2, the line terminal has a general "Z" or "S" configuration with the second end of the terminal being at a higher elevation than the first end of the terminal. The terminal is equipped with a shunt contct 26 and with one or more protrusions 28 which guide the line terminal into the molded case of the circuit breaker.

A thermal element, such as bimetallic strip 30, is attched to the second end of the interior arm 20 by welding, brazing or similar method. The other end of the bimetallic element 30 is connected by a flexible connector, such as pigtail 32, to the contact assembly 18.

An adjusting screw 32 threadably engages the interior arm 20 which has a threaded opening for receiving the screw 32. Preferably, the bimetallic element also has an opening therethrough for receiving the screw 32. The screw is fitted through an opening in a bracket 34 which restrains the head of the screw while permitting the body of the screw to pass through the opening therein. The bracket has a general U configuration with the legs of the U abutting the exterior arms. The bracket opening is located in the central portion of the U.

Operation of the line terminal assembly according to the present invention is quite simple. The pigtail, bimetallic element and line terminal, are appropriately connected together prior to installation in the molded case of the circuit breaker. The line terminal is inserted into the molded case of the circuit breaker by inserting it in the passageway and forcibly positioning it in the passageway. The line terminal must be forced into the passageway because the crushable ribs protrude into the passageway preventing unobstructed entry of the terminal into the passageway. However, the ribs are crushed when the line terminal is forcibly urged into the passageway and the deformed ribs not only help hold the line terminal in position but also help prevent its easy removal. Therefore, the crushable ribs firmly hold the line terminal in position.

Calibration is accomplished by means of the adjusting screw 32. As noted, the bimetallic element 30 is connected to the second end of the interior arm 20 and will move with the interior arm 20. The interior arm 20 is caused to move relative to the exterior arms by means of the screw 32. Adjusting the screw will cause the second end of the interior arm to move and the bimetallic element which is attached thereto moves with the interior arm. Since there is metal-to-metal contact between the adjusting screw and the interior arm and bimetallic element, there is positive calibration. It can be calculated, for example, that for each fraction of a turn of the screw, the free end of the bimetallic element will move a predetermind amount and will vary the tripping current of the circuit breaker by a preselected amount. As illustrated, the bimetallic element and electrical shunt contact are on opposed sides of the line terminal. The crushable ribs firmly hold the components in fixed positions so that calibration can be accomplished without interference from loose or shifting components.

It will now be understood that there has been disclosed an improved line terminal assembly for a circuit breaker which is simple in construction and easy to install and simplifies the calibration process. As will be evident from the foregoing description, certain aspects of the invention are not limited to the particular details of the examples illustrated, and it is therefore contemplated that other modifications or applications will occur to those skilled in the art. It is accordingly intended that the claims shall cover all such modifications and applications as do not depart from the true spirit and script of the invention.

What is claimed as new and desired to be secured by Letters Patent of the United States is:

1. A line terminal assembly for a circuit breaker having a tripping current, comprising:

an interior arm and first and second exterior arms disposed outboard of said interior arm along opposite sides thereof;

a bimetallic element having one end connected to said interior arm;

an adjusting screw treadably engaging said interior arm; and a bracket having a general U configuration with the legs of the U abutting said exterior arms and a central portion of the U having an opening through which said screw passes with a head of said screw abutting said central portion whereby turning said screw moves said interior arm and bimetallic strip reltive to said exterior arms and varies the tripping current of the circuit breaker.

2. A line terminal assembly according to claim 1 wherein each of said arms has a first end and a second end and including a connecting section electrically connecting said arms together at their first ends and a terminal section connecting said exterior arms together at their said second ends and adapted for connection in an external circuit.

3. A line terminal assembly according to claim 2, wherein the second end of said interior arm is at a different elevation than the connecting section and first ends of the arms.

4. A line terminal assembly according to claim 2, wherein the bimetallic element and bracket are positioned on opposed sides of said interior arm.

5. A line terminal assembly according to claim 4, wherein said first end of said interior arm has an electrical contact.

6. A line terminal assembly according to claim 2, wherein the first ends of the interior and exterior arms lie in a different plane than the second ends of the interior and exterior arms.

7. A line terminal assembly according to claim 2, wherein said circuit breaker has a molded case defining a passageway having ribs and said line terminal is forcibly positioned in said passageway deforming said ribs.

8. A line terminal assembly for a circuit breaker, comprising:

an interior arm and first and second exterior arms disposed outboard of said interior arm along opposite sides thereof, each of said arms having a first end and a second end;

a connecting section electrically connecting said arms together at their said first ends;

a terminal section connecting said exterior arms together at their said second ends and adapted for connection in an external circuit;

a bimetallic element having one end connected to said interior arm;

an adjusting screw threadably engaging said interior arm; and a bracket having a general U configuration with the legs of the U abutting said exterior arms and a central portion of the U having an opening through which said screw passes with a head of said screw abutting said central portion whereby turning said screw moves said interior arm and bimetallic strip relative to said exterior arms.

9. A line terminal assembly according to claim 8, wherein the second end of said interior arm is at a different evalation than the connecting section and first ends of the arms.

10. A line terminal assembly according to claim 8, wherein the bimetallic element and bracket are positioned on opposed sides of said interior arm.

11. A line terminal assembly according to claim 10, wherein said first end of said interior arm has an electrical contact.

12. A line terminal assembly according to claim 8, wherein the first ends of the interior and exterior arms lie in a different plane than the second ends of the interior and exterior arms.

13. A line terminal assembly according to claim 8, wherein said circuit breaker has a molded case defining a passageway having ribs and said line terminal is forcibly positioned in said passageway deforming said ribs.

* * * * *